US005430520A

United States Patent [19]

Toki et al.

[11] Patent Number: 5,430,520

[45] Date of Patent: Jul. 4, 1995

[54] METHOD AND APPARATUS FOR DEVELOPING PHOTOSENSITIVE MATERIAL

[75] Inventors: Akihiko Toki; Eiji Motooka, both of Wakayama, Japan

[73] Assignee: Noritsu Koki Co., Ltd., Wakayama, Japan

[21] Appl. No.: 245,903

[22] Filed: May 19, 1994

[30] Foreign Application Priority Data

May 26, 1993 [JP] Japan ..... 5-124138

[51] Int. Cl.[6] ..... G03D 3/08

[52] U.S. Cl. ..... 354/319; 271/14; 271/84; 271/267; 271/286

[58] Field of Search ..... 354/319-324; 271/14, 42, 84, 267, 270, 286; 414/791.2

[56] References Cited

U.S. PATENT DOCUMENTS 4,223,777 9/1980 Aykut ..... 198/365

5,374,972 12/1994 Nakane ..... 354/319

*Primary Examiner*—D. Rutledge

*Attorney, Agent, or Firm*—Wenderoth, Lind & Ponack

[57] ABSTRACT

The exposed photosensitive materials are staggered into two lines, while being fed to the developing unit, for higher efficiency in development. The carrier unit B has a staggering unit and a parallel carrier path having a pair of parallel paths. The staggering unit staggers the photosensitive materials into each of two parallel paths alternately while moving in a direction perpendicular to the direction of feed.

4 Claims, 4 Drawing Sheets

20B
20
13
10
20A
PC1

20B
PC1
13
20A

20B
PC1
13
20A

20B
PC1
13
PC2
20A

PC2
20B
13
PC1
20A
PC3

METHOD AND APPARATUS FOR DEVELOPING PHOTOSENSITIVE MATERIAL

BACKGROUND OF THE INVENTION

1. Field of the Invention

This invention relates to a method and apparatus for efficiently developing a photosensitive material which has been exposed to the light for printing.

2. Description of the Prior Art

Ordinarily, on a photograph printing apparatus, a photosensitive material is fed continuously from a roll to an exposure table provided in the exposure unit where an image on the negative film is printed on each frame by exposing it to the light. Next, the photosensitive material is fed to a developing unit by a carrier unit. It is developed while passing through a tank containing different developing solutions. The photosensitive material is then dried and the photographs are delivered.

The photosensitive material to be exposed to the light on the exposure table is previously cut into sheets of paper for the convenience of developing. The sheets are fed in line to the developing unit in which a space of several tens of millimeters is provided to avoid contact between each pair of sheets of the photosensitive material.

In such conventional film printing apparatus, the developing speed for developing the photosensitive material was usually much lower than the speed for printing the photosensitive material by exposing it to the light. Thus, in order to improve the treatment capacity of the film printing apparatus, it was necessary to improve the treatment capacity of the developing unit.

However, in such a conventional method, although the treatment speed for each frame was set as high as possible, there was a limit. In order to overcome this problem, it has been proposed to increase the rack length of the carrier unit for carrying the photosensitive material in the developing unit to increase the number of the sheets developed per hour, and thus increase the treatment speed in the developing unit.

With increase in the rack length, the entire size of the developing unit as well as the size of the tank increased, too. Thus, the amount of developing solutions, both main and supplemental solutions, inevitably increased. For example, in the photosensitive material having a certain width, to increase the treatment capacity from 500 sheets per hour to 1000 sheets per hour, the rack length had to be 210% longer and the amount of the main and supplemental developing solutions had to be increased to 200%.

SUMMARY OF THE INVENTION

It is an object of the present invention to provide a method and apparatus for developing photosensitive material with high efficiency.

According to the present invention, there is provided a method for developing a photosensitive material comprising the steps of feeding an exposed photosensitive material while staggering the feed direction to the right and left in turn, and developing the photosensitive material while keeping a zigzag pattern by adjusting the feed speed.

Further, there is provided an apparatus for developing a photosensitive material comprising a developing unit, a carrier path for feeding a photosensitive material to the developing unit, a staggering unit provided in the carrier path for staggering the feed direction to the right and left in turn, a variable speed driving means for changing the feed speed for feeding the photosensitive material, and a developing unit for developing the photosensitive material while feeding it in a zigzag arrangement.

A plurality of parallel carrier paths should preferably be provided downstream of the staggering unit, and a plurality of variable speed driving means may be separately provided for the respective parallel carrier paths instead of providing the variable speed driving means for the staggering unit.

According to the present invention, the photosensitive paper, exposed to the light for printing, is fed through the carrier path in parallel and staggered shape and each piece of the paper is fed in a parallel zigzag pattern by adjusting the feed speed, the developing speed for these pieces of the photosensitive paper is higher than in the conventional developing unit. Further, as in the conventional apparatus, each space between the respective pieces can be maintained, the paper is developed smoothly without being interrupted by overlaps. Therefore, the photosensitive material is efficiently developed.

BRIEF DESCRIPTION OF THE DRAWINGS

Other objects and features will become apparent from the following description taken with reference to the accompanying drawings, in which.

DETAILED DESCRIPTION OF THE INVENTION

Figure 1:
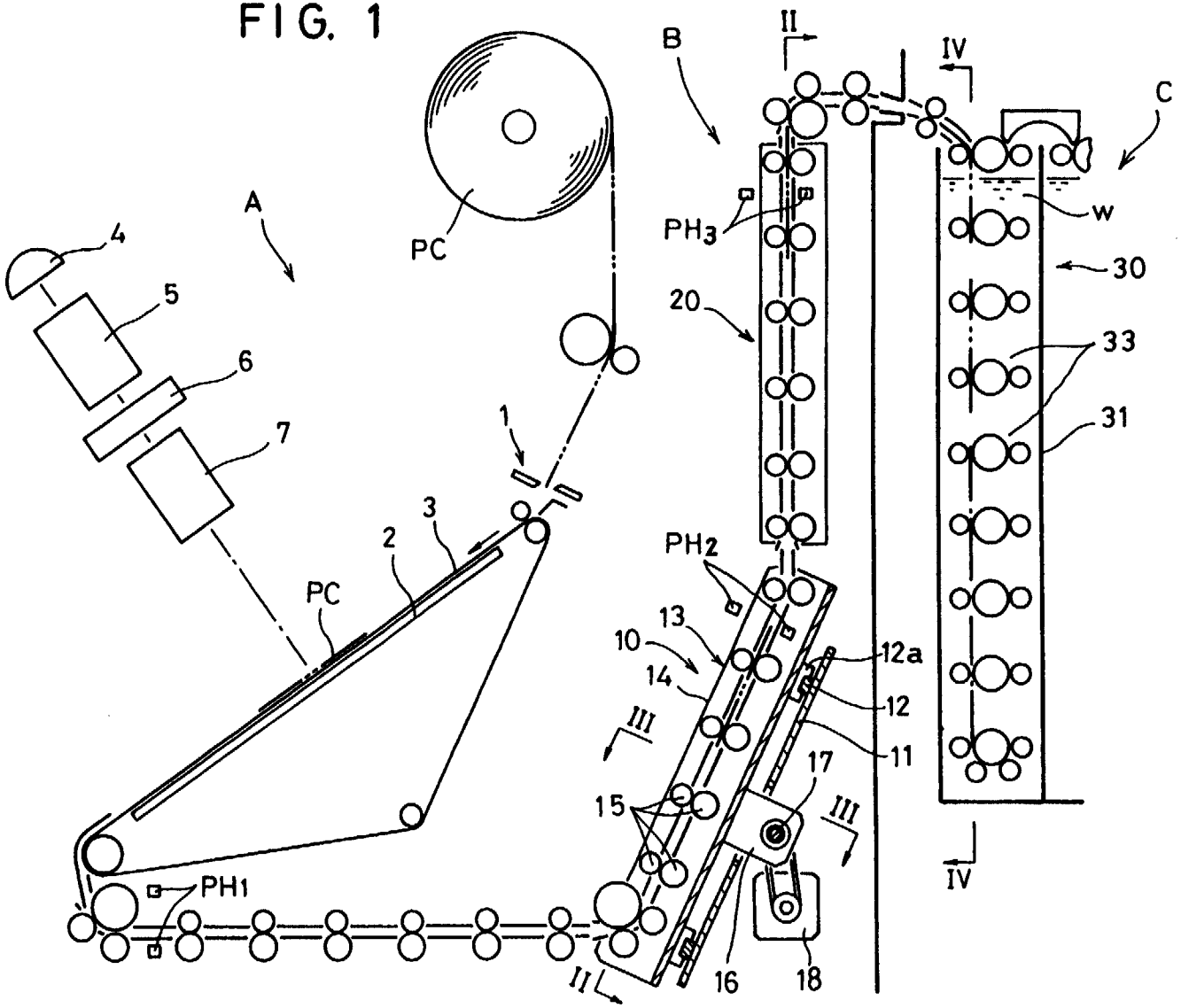
FIG. 1 is an enlarged sectional view showing the developing unit and the exposure unit with their boundary.

Referring to FIG. 1, in an exposure unit A, after a photosensitive material PC has been fed from a roll by feed rollers and cut into frames by a cutter 1, it is fed to an exposure table 2 by means of feed rollers.

As shown in FIG. 1, three rollers are provided at each vertex of a triangular section. Around the rollers is provided an endless absorbing belt 3. By moving the absorbing belt 3 in a direction shown by arrow, the photosensitive material PC is fed to a predetermined position. The absorbing belt 3 is formed with numerous small pores through which the photosensitive material PC is sucked by vacuum to the absorbing belt 3. The photosensitive material PC, now fed to the predetermined position, is exposed to the light from a light source 4 through a mirror tunnel 5, a shutter 6 and a lens unit 7. The exposed photosensitive material PC is then fed to a developing unit C by means of a carrier unit B.

The carrier unit B comprises a plurality of pairs of rollers. Though not shown, around the ends of the rollers is provided an endless belt for driving the rollers. A carrier-staggering unit 10 and a parallel carrier path 20 are provided in the carrier unit B.

In the figure, PH1, PH2 and PH3 designate sensors for detecting the photosensitive material PC.

Figure 2:
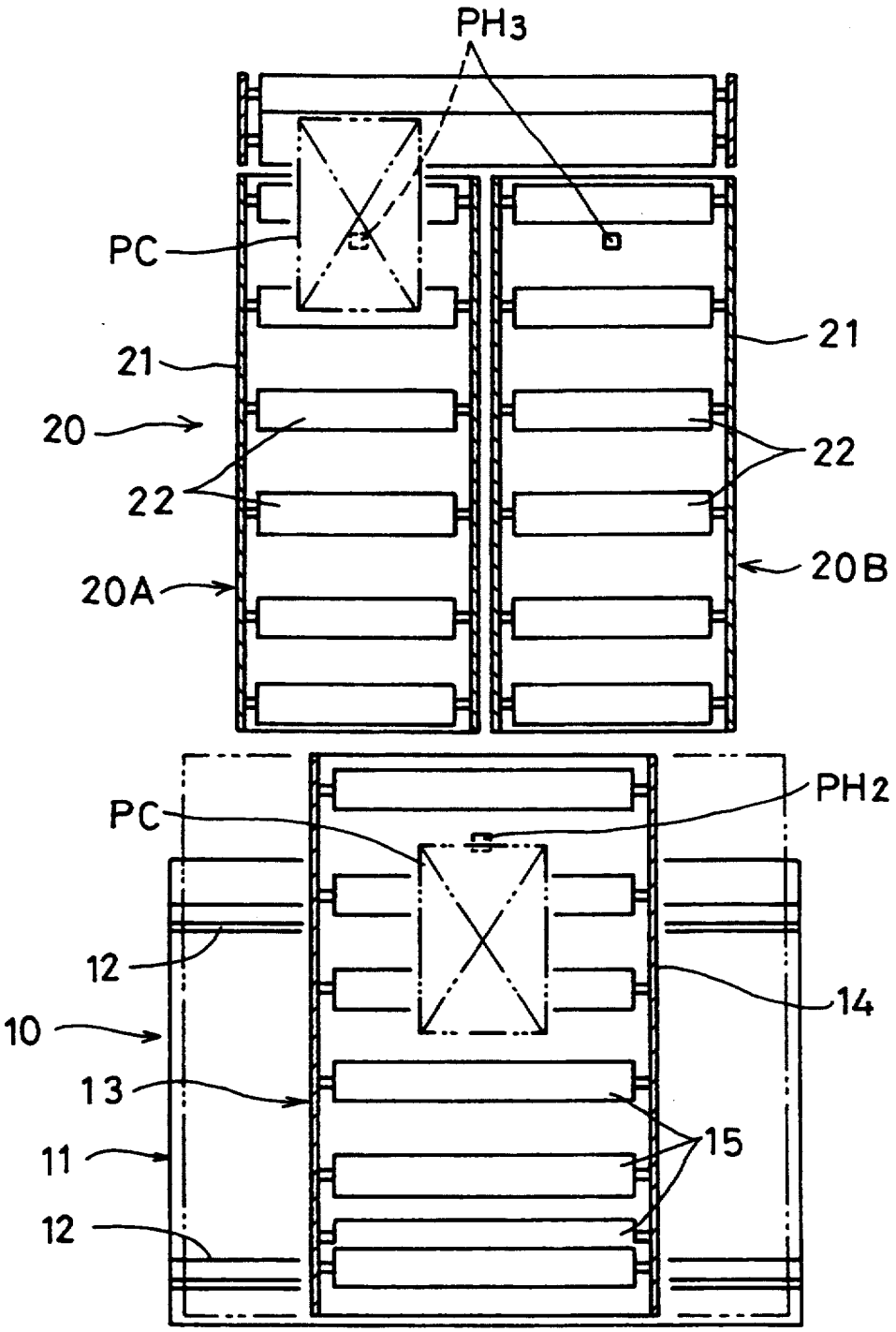
FIG. 2 is a sectional view taken along line II—II of FIG. 1.
Figure 3:
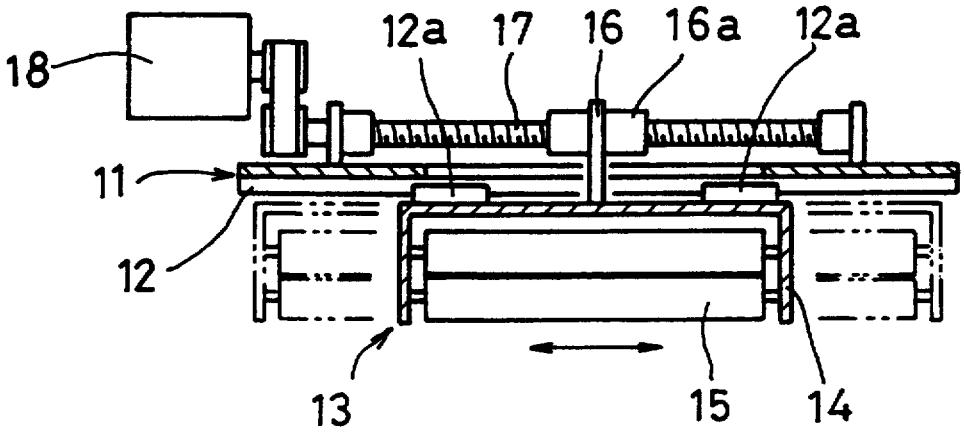
FIG. 3 is a sectional view taken along line III—III of FIG. 1.

FIGS. 2 and 3 show sectional views taken along lines II—II, III—III of FIG. 1, respectively. The units 10 and 20 are provided substantially vertically.

The carrier-staggering unit 10 comprises a base 11 provided with rails 12 thereon, and a movable path 13 which can traverse in a direction perpendicular to the feed direction of the photosensitive material PC. The movable path 13 is provided with a movable frame 14 having a plurality of pairs of rollers 15 and slidably engages a rail 12 through guides 12*a* provided at its bottom.

The movable path 13 further comprises a protruding arm 16 provided at the bottom of the movable frame 14 so as to extend through the base 11, a screw fitting portion 16*a* provided at one end of the protruding arm 16 to receive a ball screw 17, a motor 18 for driving the ball screw 17 so that the movable path 13 is movable in either of rightward and leftward directions with respect to the carrier path.

As shown in FIG. 2, the parallel carrier path 20 comprises two carrier paths 20A and 20B parallelly formed, each of which is provided with a plurality of pairs of rollers 22 on a base 21. By driving an endless belt (not shown) passing around the ends of the rollers by means of a motor, pairs of rollers are rotated to feed the photosensitive material PC. Driving units can be provided separately for the respective carrier paths. The feed speed can be changed freely, high and low. Usually, the material receiving side of the parallel carrier path 20 is driven at a high speed whereas the outlet side is at a low speed.

Further, the width of both carrier paths 20A and 20B is set to be substantially the same as that of the exposure table 2. Thus, the width of the parallel carrier path 20 is substantially twice as that of one carrier path. On the other hand, the width of the carrier-staggering unit 10 is more than twice as large as that of the exposure table 2.

Figure 4:
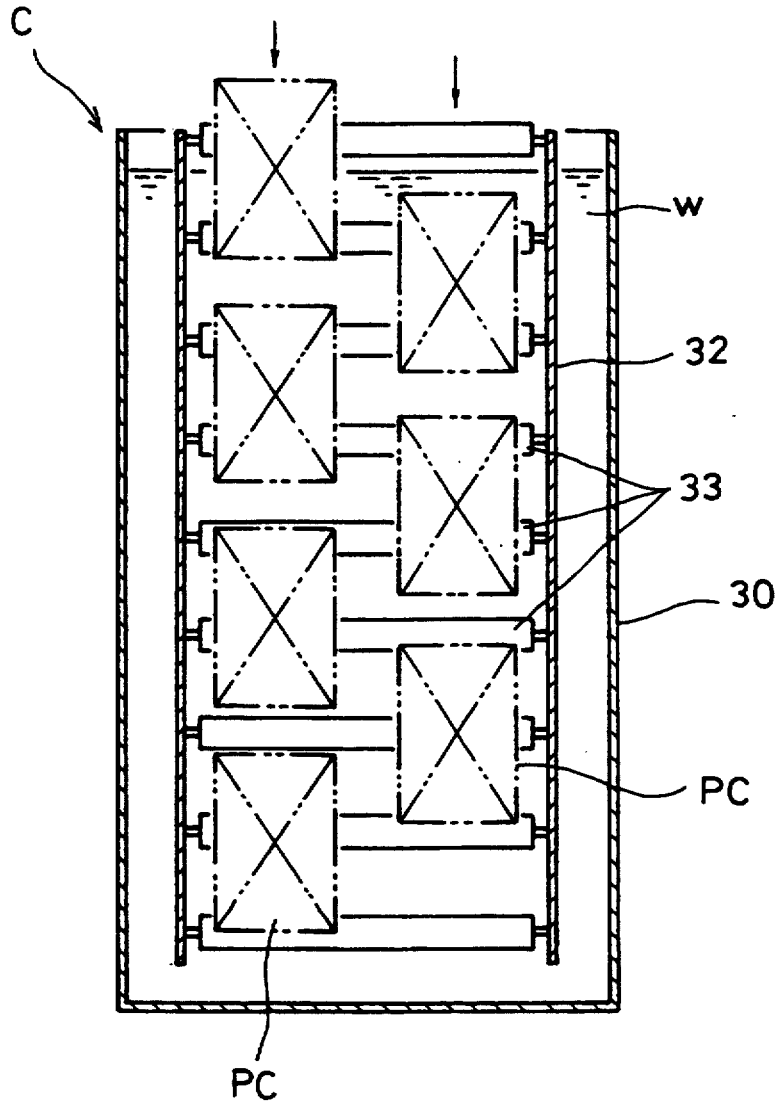
FIG. 4 is a sectional view taken along line IV—IV of FIG. 1.
Figures 5A, 5B, 5C, 5D, 5E:
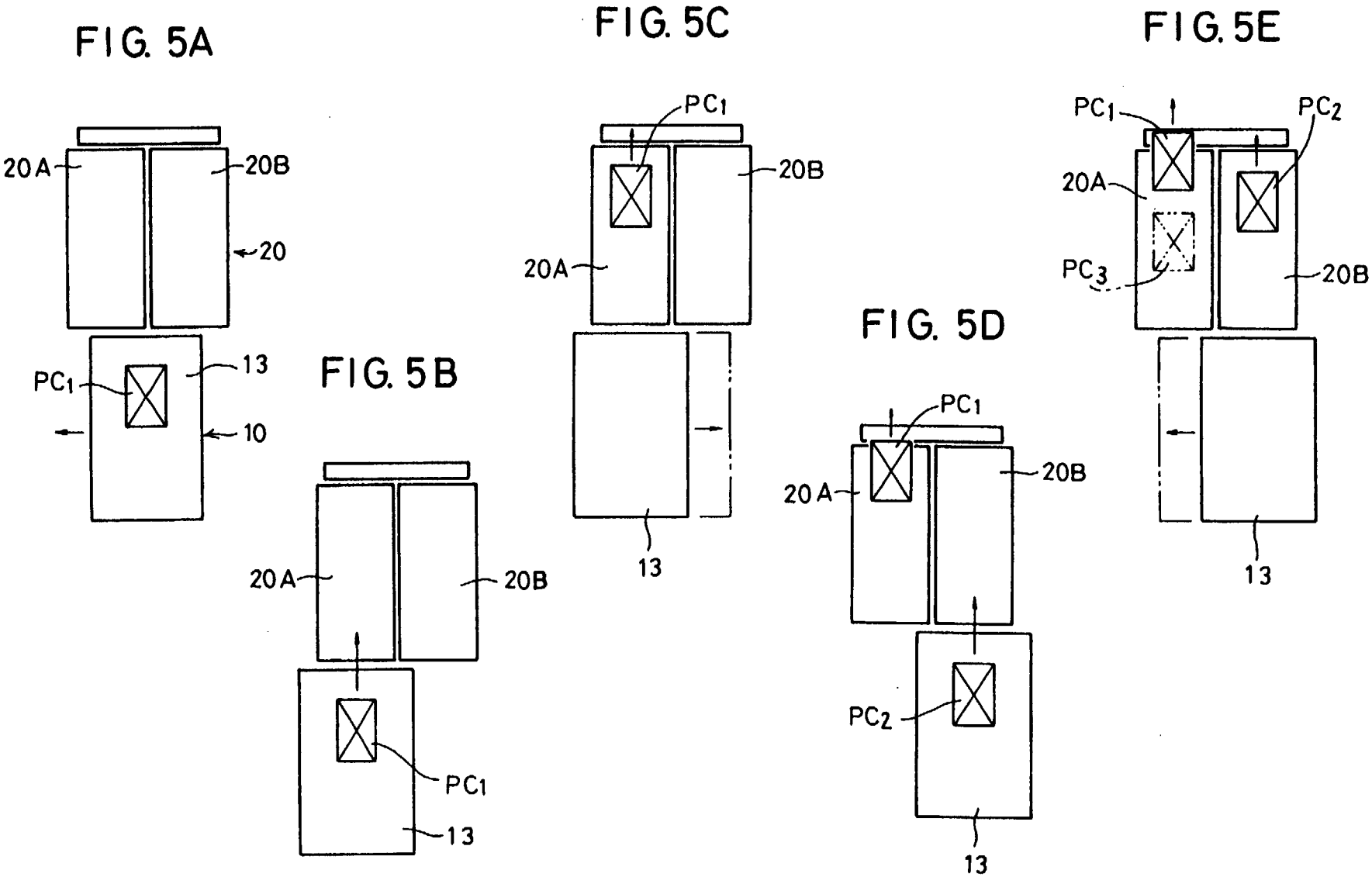
FIGS. 5A-5E are views showing how it operates.

FIG. 4 is a sectional view taken along line IV—IV of FIG. 1, showing the basic structure of the interior of the developing unit C. It includes a tank 30, a partitioning plate 31 for separating the tank into several portions in which different kinds of developing solutions W are filled to develop the photosensitive paper. FIG. 4 shows only one portion, but other portions have the same structure as this one.

In each portion is provided a rack horizontally supporting a plurality of pairs of rollers 33 to a frame 32. The rack width (and thus the roller width) in each portion is set to be substantially the same as the parallel carrier path 20. Also, the tank 30 has a sufficient width to accommodate the rack.

In this arrangement, as shown in FIG. 1, the photosensitive material PC is fed to the top of the developing unit C by turning the feed direction at the top of the carrier path B by a pair of rollers.

Now we shall explain how the photosensitive paper is developed in the developing unit of the above-described structure.

After exposed in the exposure unit A for printing, cut pieces of the photosensitive material PC are fed in turn to the carrier-staggering unit 10 by the pair of rollers at the entrance of the carrier unit B. In this state, the movable path 13 receives the photosensitive material PC with its central position in the width direction aligned with the center of the entrance of the carrier unit B.

As shown in FIGS. 5A-5E, while the photosensitive material PC is fed downstream inside the movable path 13, the latter moves leftward from 5A to 5B. During the state 5B, the first photosensitive material PC1 is fed to the carrier path 20A. In 5C, after the photosensitive material PC1 has been fed near the top of the carrier path 20A at high speed, it moves further slowly by shifting its speed to low. At the same time, the movable path 13 returns to its original position.

Next, as shown in the state 5D, PC1 will keep moving forward slowly. During that time, the movable path 13 receives the next photosensitive material PC2 and moves toward the carrier path 20B to the right. After it has been received in the carrier path 20B, it moves forward at high speed until it reaches near the top thereof and then moves at low speed in the same manner as PC1.

In the state 5E, while PC1 and PC2 are fed to the developing unit at a common low speed, the movable path 13 returns to its original position. Then, the movable path 3 receives the next photosensitive material PC3. As shown in a chain line in the figure, the photosensitive materials PC1-PC3 are parallelly fed to the developing unit C while keeping a space in a zigzag arrangement with respect to one another.

In this embodiment, as a carrier unit for parallelly feeding the photosensitive materials PC1-PC3 to the developing unit C in a zigzag arrangement having a predetermined space, variable-speed driving means are separately provided for the parallelly-arranged carrier paths 20A and 20B of the carrier path 20, but they may not be provided on the parallel carrier path 20. For example, they may be arranged in the following manner.

Namely, in the above embodiment, the carrier-staggering unit 10 and the parallel carrier path 20 are mounted in the carrier unit. Instead of providing the parallel carrier path 20, the carrier staggering unit 10 may be formed longer than the one in the above embodiment and provided nearer to the developing unit. Also, variable speed driving means may be mounted to drive the feed roller 15 in such a manner that it will be driven at high speed at the receiving side and at low speed at the delivering side of the photosensitive material PC.

Furthermore, in the above embodiment, the slide rail and the ball screw are provided as a driving unit for driving the carrier staggering unit 10, but they may be a combination of a rack pinion and a crank mechanism.

Also, in any of embodiments, there is no need to stagger parallelly the photosensitive material PC inside the carrier-staggering unit 10. It may be fed in line to the parallel carrier path 20 and the developing unit C. Thus, the photosensitive material having a large width can be developed and treated.

What is claimed is:

1. A method for developing a photosensitive material comprising the steps of feeding an exposed photosensitive material while staggering the feed direction alternately to the right and left, and developing said photosensitive material while keeping a zigzag pattern by adjusting the feed speed.

2. An apparatus for developing a photosensitive material comprising a developing unit, a carrier path for feeding a photosensitive material to said developing unit, a staggering unit provided in said carrier path for staggering the feed direction alternately to the right and left, a variable speed driving means for changing the speed for feeding said photosensitive material, and a developing unit for developing said photosensitive material while feeding it in a zigzag arrangement.

3. An apparatus for developing a photosensitive material as claimed in claim 2, wherein said variable speed driving means is provided for said staggering unit.

4. An apparatus for developing a photosensitive material as claimed in claim 2, wherein a plurality of parallel carrier paths are provided downstream of said staggering unit, and wherein said variable speed driving means is separately provided for each of said respective parallel carrier paths.

* * * * *